United States Patent [19]

Teague

[11] 3,958,545

[45] May 25, 1976

[54] FUEL INJECTORS

[76] Inventor: James E. Teague, 221 N. Emery Drive, Apt. No. 7, Sterling, Va. 22170

[22] Filed: June 30, 1975

[21] Appl. No.: 591,394

[52] U.S. Cl. ..... 123/139 AJ; 123/33 C; 123/33 J; 123/139 A; 239/87

[51] Int. Cl.[2] ..... F02M 49/02

[58] Field of Search ..... 123/139 AJ, 139 A, 33 C, 123/33 J; 239/87

[56] References Cited

UNITED STATES PATENTS

| | | | |
|---|---|---|---|
| 2,055,580 | 9/1936 | Larsson et al. | 239/91 |
| 2,241,508 | 5/1941 | Fague | 123/139 AJ |
| 2,518,901 | 8/1950 | King | 123/139 AJ |
| 2,740,667 | 4/1956 | Dickson et al. | 123/139 AJ |

*Primary Examiner*—Wendell E. Burns
*Assistant Examiner*—James W. Cransen, Jr.

[57] ABSTRACT

A fuel injector for an internal combustion engine having a combustion chamber provided with a pressure outlet bore and an unalined fuel inlet bore and which is characterized by a high pressure injecting mechanism at the junction of the chamber with the fuel inlet bore adapted to be positively driven by a fixed-length motion transmission linkage which, in turn, is responsive to pressures above predetermined amounts in said inlet bore. Specifically, the linkage is composed of a plunger reciprocably mounted in the outlet bore, a second plunger serving as a pump piston and reciprocably mounted in the fuel inlet bore, and a rocker arm interconnecting the plungers. The inlet bore is capped by an atomizing nozzle disposed in the upper portion of the combustion chamber.

The injector is further characterized by means for varying the predetermined pressures to which the linkage responds.

10 Claims, 9 Drawing Figures

FUEL INJECTORS

This invention relates to fuel injectors for internal combustion engines and more especially to engines of the diesel type in which the injected fuel is ignited by the heat generated by compression.

Heretofore, numerous types of fuel injectors have been provided in which a relatively high pressure injecting mechanism is operated in response to the combustion pressure through an intermediate longitudinally flexible drive. U.S. Pat. Nos. 2,055,580, 2,385,239 and 2,602,702 disclose typical prior art devices of the type described.

Many of the above-mentioned conventional injectors employ a yieldable motion and pressure transmission which varies in length as the compression pressure increases and decreases. As a consequence, the operation of the injecting mechanism lags behind the corresponding compression pressure rather than instantaneously reflecting it.

It is therefore an object of this invention to provide a fuel injector wherein the injecting mechanism thereof is positively and precisely operated in response to the compression pressure through an intermediate lever linkage of a fixed length.

It is another object of the invention to provide means for preventing movement of the transmission linkage until a predetermined high compression pressure is attained.

It is a further object of the invention to provide means for varying the predetermined transmission pressures to which the linkage will respond, thereby permitting adjustment of the timing of fuel injection relative to the compression pressure.

It is another object of the invention to provide an improved fuel injector of the type described which replaces the conventional carburetor, distributor and spark plugs and is capable of use with the existing low pressure fuel pumps and air supply components of automotive vehicles.

It is yet another object of the invention to provide a fuel injector of the type described which employs a minimum number of parts, is simple in construction, efficient in operation, and capable of giving a better burn and fuel mileage with a corresponding reduction of pollution.

Some of the objects of invention having been stated, other objects will appear as the description proceeds when taken in connection with the accompanying drawings, in which, FIG. 1 is a diagrammatic view of a portion of an internal combustion engine, including a throttle control and my improved fuel injectors;

Figure 2:
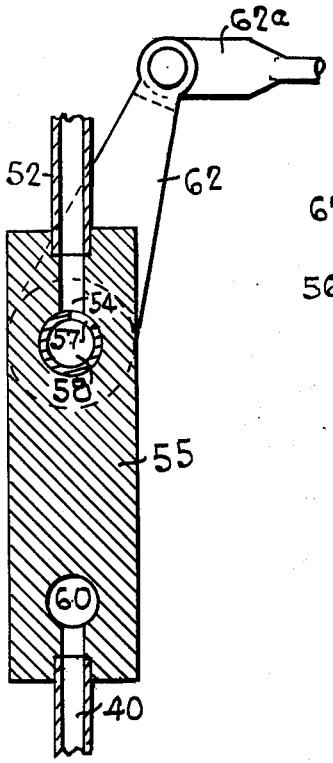
FIG. 2 is an enlarged sectional view taken along line 2—2 in FIG. 1.

Referring more particularly to the drawings, the numeral 10 denotes a conventional internal combustion engine having block 11 with head portion 12, cylinders 14, pistons 15 and combustion chambers 16. Each of my improved fuel injectors 20 is removably mounted in a bore 21 of head portion 12.

The injector 20 is composed of an elongated body portion 22 having parallel bores 24 and 25 therein in which master plunger 26 and slave plunger 27 are reciprocably mounted respectively. Although the plungers are illustrated in parallel positions, the invention is not so limited, but instead, includes numerous possible unalined positions as well.

Figure 4:
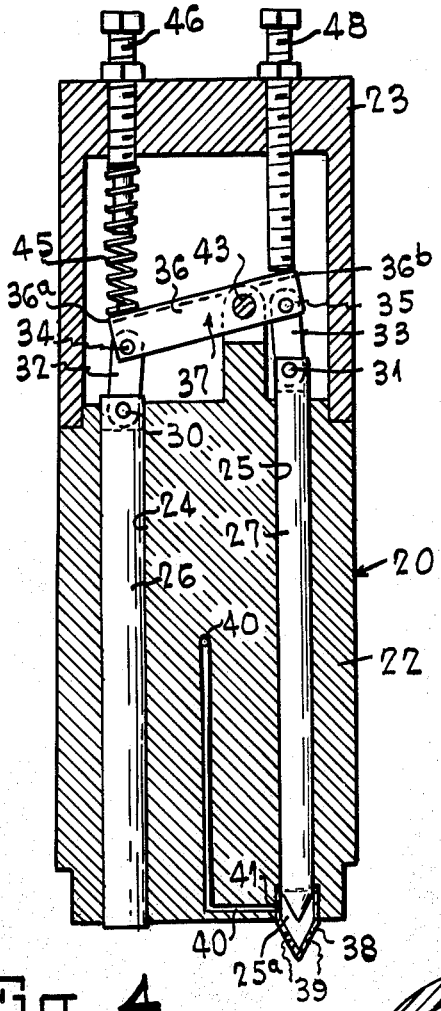
FIG. 4 is a vertical sectional view taken along line 4—4 in FIG. 3.
Figure 3:
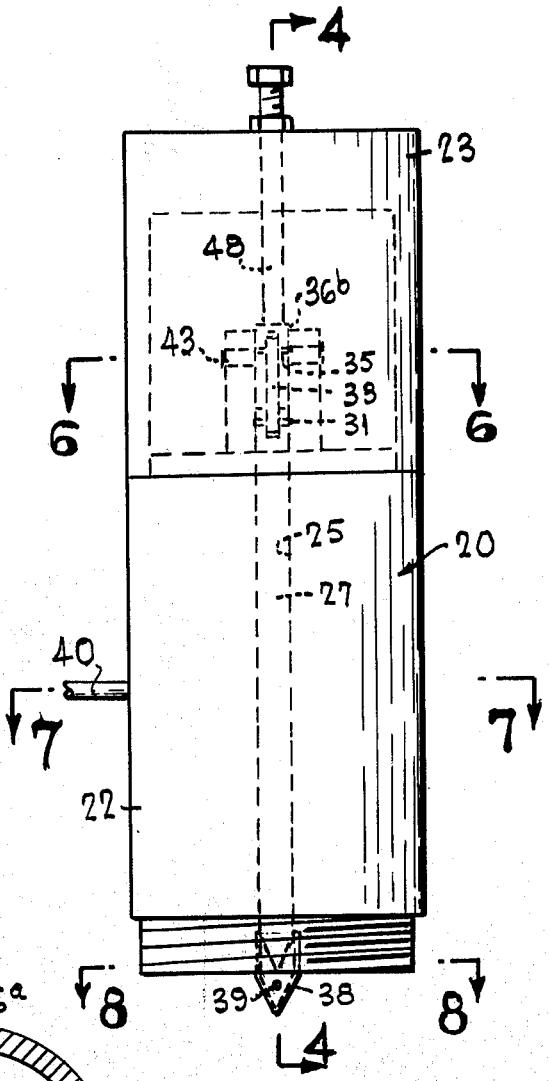
FIG. 3 is an enlarged elevational view of one of the injectors and taken along line 3—3 in FIG. 1.
Figure 6:
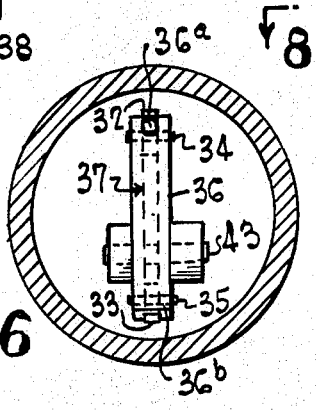
FIG. 6 is a sectional plan view taken along line 6—6 in FIG. 5.

The upper ends of plungers 26 and 27 are pivotally secured as at 30 and 31 to links 32 and 33 respectively, the upper ends of said links being pivotally secured as at 34 and 35 respectively to the opposite ends of rocker arm 36 which is pivoted or fulcrumed intermediate its ends as at 43 (FIG. 4). It will be observed that the parts 32, 34 and 36 constitute a positive driving connection or lever linkage 37 having a fixed length, which linkage transmits precisely and instantaneously the reciprocatory movements of one of the unalined plungers to the other as determined by the linkage design.

The lower end of bore 25 is restricted by an atomizing nozzle 38 having minute spray orifices 39 therein. These orifices permit the passage of fuel under relatively high pressure, as later described, but limit the upward pressure from the compression chamber 16 acting against the lower end of slave plunger 27 as compared with the chamber pressure acting upon the lower end of master plunger 26 in the unrestricted bore 24. Thus the greater upward pressure applied to the master plunger during the power stroke of piston 15 will rock arm 36 about fulcrum 43 while moving the master plunger upwardly and the slave plunger downwardly.

The ratio of movement of the master plunger 26 to the movement of the slave plunger 27 depends upon the lateral position of the fulcrum point 43 and will vary to satisfy the conditions of use. A satisfactory movement ratio as between the master and slave plungers has been found to be approximately 4 to 1.

Fuel is supplied to space **25*a* at the lower portion of bore 25 by means of conduit 40, said conduit merging with the space at port 41. During the power stroke of piston 15, the slave plunger 27 will move downwardly from the position shown in FIG. 4, during which the fuel supply port 41 will be closed and the charge of fuel in space 25*a* expelled through orifices 39 into combustion chamber 16. A check valve 42 in each of the conduits 40 (FIG. 1) prevents reverse flow of the fuel from the injectors 20** during the power stroke.

During operation, it is necessary for the movement of lever linkage 37 to begin when a pretedermined compression pressure is reached. A spring 45 serves this function. The lower end of spring 45 abuts the end **36*a* of rocker arm 36 and the upper end abuts adjustment screw 46 threadably secured in cap portion 23 of body member 22. By manipulating screw 46, the tension in spring 45 may be varied as desired to permit the master plunger 26 therebelow to begin upward movement when a predetermined compression pressure is reached. In other words, the plunger 26 and associated parts of linkage 37 will remain motionless until the pressure builds up to a predetermined amount. By this adjustment of spring tension, the timing of fuel injection is varied relative to different compression pressures as conditions require. The lower end of a second adjustable screw 48 limits the upward or counterclockwise rotation of the rocker arm end 36***b*, said second screw being threadably secured in cap 23.

Figure 1:
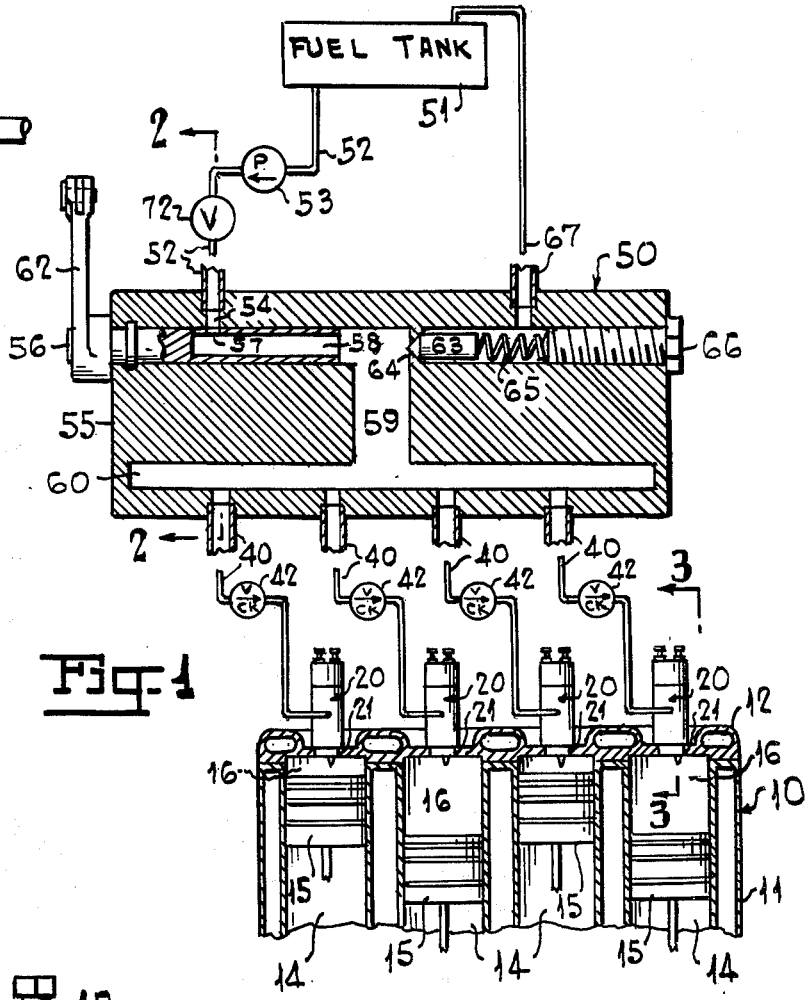

A throttle control assembly, broadly designated by numeral 50, governs the flow of fuel from a tank 51 to the conduits 40 and then to injectors 20 (FIGS. 1 and 2). Specifically, the fuel flows from the tank through fuel pump 53 and electrical stop valve 72 in conduit 52, and then into port 54 of the throttle control body member 55. A throttle shaft 56 is mounted for oscillation in the body member by any suitable means such a lever 62 and associated operating link 62*a*. Shaft 56 has a transverse port 57 therein which is adapted to coincide with the port 54 to permit the fuel to flow from conduit 52, into a longitudinal bore 58 of shaft 56, into passageways 59 and 60, and then through the previously described conduits 40 to injectors 20. By oscillating shaft 56, the coinciding areas of ports 54 and 57 may be increased or decreased to control the fuel flow. A pressure bypass consisting of plunger 63, seat 64, spring 65 adjustment screw 66, and conduit 67 permits excess amounts of fuel in passageways 58, 59 and 60 to automatically return to tank 51.

Figure 9:
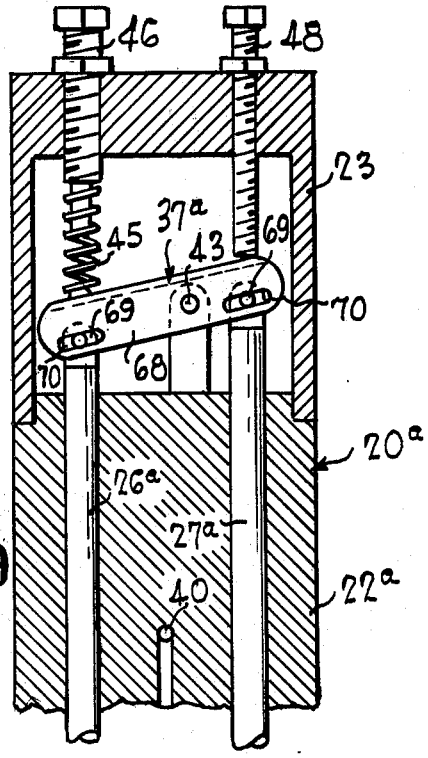
FIG. 9 is an enlarged vertical sectional view similar to the upper portion of FIG. 4, but showing a modified form of fuel injector.
Figure 8:
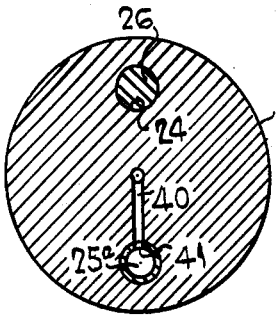
FIG. 8 is a sectional plan view taken along line 8—8 in FIG. 5.
Figure 7:
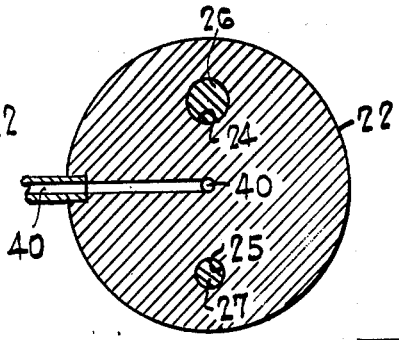
FIG. 7 is a sectional plan view taken along line 7—7 in FIG. 5.
Figure 5:
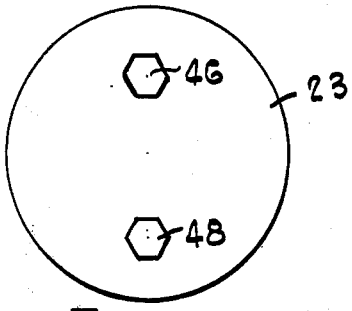
FIG. 5 is a top plan view of FIG. 3.

The modified form of invention shown in FIG. 9 is identical to FIGS. 1–8 except for certain specific differences in the lever linkage and associated plungers. Unlike the previously described injector, the plungers 26*a* and 27*a* in FIG. 9 are of the same size, and the upper ends thereof are directly connected to the opposite ends of rocker arm 37*a* by means of sliding pivots each consisting of a pin 69 and a slot 70.

OPERATION

The throttle lever 62 and associated shaft 56 are oscillated to permit fuel to flow from tank 51, through ports 54 and 57, passageways 58, 59 and 60, conduits 40, and into injectors 20 in the order named.

As piston 15 travels its intake stroke (FIGS. 1 and 4), spring 45 will push master plunger 26 downwardly and lift the connected slave plunger 27 off its seat in nozzle 38 to open fuel supply port 40, at which time the fuel will flow into space 25*a*. As piston 15 travels its compression stroke, spring 45 will prevent movement of linkage 37 and associated plungers 26 and 27 until the compression reaches a predetermined amount corresponding to the tension applied to the spring by adjustment screw 46. This screw is employed to time the injector to the engine with which it is associated. When the predetermined pressure is attained, spring 45 will yield to allow the plunger 26 to move upwardly while the plunger 27 moves downwardly to close fuel port 40 and expel the charge of fuel from space 25*a*, through openings 39, and into combustion chamber 16.

As combustion starts to build, so will the power of the master over the slave plunger. As piston 15 is travelling its power stroke, the injector will continue to inject until all fuel is exhausted from the nozzle or tip 38, thus prolonging the combustion time, attaining a better fuel mixture, and cleaner burn with decreased pollution.

I claim:

1. In an internal combustion engine (10), a block (11, 12) having at least one combustion chamber (16), said block having an opening (21) therein communicating with said chamber, a body member (22) mounted in said opening, said member (22) having a pair of axially unalined bores (24, 25) extending outwardly from said chamber, a pair of plungers (26, 27) reciprocably mounted in said bores respectively, a fixed-length driving connection (37) for instantaneously transmitting the reciprocable movements of the plungers (26, 27) one to another, an atomizing nozzle (38) restricting the communication between the inner end of one of said bores (25) and said chamber (16), the inner end of the other of said bores (24) having relatively unrestricted communication with said chamber, and means (40) for supplying a charge of fuel into said restricted bore (25) at an inlet (41) located upstream from said nozzle (38), the plunger (27) in said restricted bore (25) being movable downstream toward said nozzle to close said inlet (41) and to expel said fuel charge in the order named.

2. The improvement described in claim 1 wherein said connection (37) includes a rocker arm (36) pivotally mounted intermediate its ends (36*a*, 36*b*), and means (34, 35) for pivotally connecting said plungers (26, 27) to the opposite ends of said arm respectively.

3. The improvement defined in claim 1 and further comprising means (45) responsive to a predetermined chamber pressure acting upon the plunger (26) in said unrestricted bore (24) for initiating downstream movement of the plunger (27) in said restricted bore.

4. The improvement defined in claim 3 and further comprising means (46) for adjusting said effective predetermined pressure means (45) to correspondingly adjust the timing of the fuel injection relative to the compression pressure.

5. The improvement defined in claim 4 wherein said first-named adjusting means (46) includes a spring (45) axially alined with the plunger (26) in said unrestricted bore to resist the compression pressure, and screw means (46) for varying the tension in said spring.

6. The improvement defined in claim 2 and further comprising means (37) responsive to a predetermined chamber pressure acting upon the plunger (26) in said unrestricted bore for initiating downstream movement of the plunger (27) in said restricted bore.

7. The improvement defined in claim 6 and further comprising means (46) for adjusting said effective predetermined pressure means (45) to correspondingly adjust the timing of fuel injection to the compression pressure.

8. The improvement defined in claim 7 wherein said first-named adjusting means (46) includes a spring (45) axially alined with the plunger (26) in said unrestricted bore to resist the compression pressure, and screw means (46) for varying the tension in said spring.

9. The improvement defined in claim 1 wherein the movement of the plunger (26) in said unrestricted bore bears a fixed ratio greater than unity to the movement of the plunger (27) in said restricted bore.

10. The improvement defined in claim 2 wherein the leverage length of said arm (36) between said intermediate pivot (43) and said pivotal connection (35) to the plunger (27) in said restricted bore is less than the leverage length of said arm between said intermediate pivot and the pivotal connection (34) to the plunger (26) in said unrestricted bore, whereby the movement of the latter plunger relative to the former will be multiplied.

* * * * *